United States Patent [19]

Smethers, Jr.

[11] Patent Number: 4,797,680

[45] Date of Patent: Jan. 10, 1989

[54] AIRBORNE ANTENNA PLATFORM

[75] Inventor: Rollo G. Smethers, Jr., Atlanta, Ga.

[73] Assignee: Lockheed Corporation, Calabasas, Calif.

[21] Appl. No.: 776,264

[22] Filed: Sep. 16, 1985

[51] Int. Cl.[4] ..... H01Q 1/28

[52] U.S. Cl. ..... 343/705; 343/718

[58] Field of Search ..... 343/705–708, 343/718, 741, 757, 866, 872, 887, 892

[56] References Cited

U.S. PATENT DOCUMENTS 2,955,776 11/1960 Ziegler ..... 343/705

4,325,141 4/1982 Ghose ..... 343/705

*Primary Examiner*—Theodore M. Blum

*Assistant Examiner*—Gregory C. Issing

*Attorney, Agent, or Firm*—Eric R. Katz

[57] ABSTRACT

An airborne antenna platform is disclosed capable of providing near-continuous spherical coverage of the volume surrounding the airborne platform.

8 Claims, 5 Drawing Sheets

W
30°
37
31
33

37
31
-30°
W

W
60°
31

39
31
-60°
W
39

W
31

39
W
31

● ACTIVE DIPOLE
○ INACTIVE DIPOLE

AIRBORNE ANTENNA PLATFORM

TECHNICAL FIELD

The present invention generally relates to an airborne antenna platform for transmitting and receiving electromagnetic energy, and more particularly, to an airborne antenna capable of providing near continuous spherical coverage of the volume surrounding the airborne platform.

BACKGROUND ART

An antenna is the mechanism by which electromagnetic energy is radiated and received. The types and variations of antenna are extremely numerous, each type being of some particular advantage over the others for a specific requirement. Among the more important and frequently encountered requirements are those for operating bandwidth, directivity, both high and low, and polarization. Mounting factors for antennas, as in land vehicles, aircraft, and spacecraft, also pose problems of size, weight, air resistance, and vehicle interference.

For radar, although not necessarily for antennas in other electromagnetic applications, it is essential that the antenna enhance performance. A radar antenna has three basic roles: to be a major contribution to the radar's sensitivity, to provide the required surveillance and to allow measurements of angle of sufficient accuracy and precision.

One application where antenna configuration has been of considerable importance is airborne radar systems. Airborne radar systems, such as, for example, the radar in the U. S. Air Force's E-3A Airborne Warning and Control System (AWACS), use pulse-doppler radars; airborne pulse-doppler radars being more difficult to design and more complex than ground-based systems.

Performance of airborne radar of the early warning (EW) type have been limited by the physical constraints of the antenna. These constraints include range limitations as well as the inability to discriminate against targets of relatively small size.

Typical EW antennas are those utilized by the E-1, E-2, and E-3 aircraft, such antennas being dish antennas housed in a rotating dome situated above the fuselage of the aircraft by means of a pylon or the like. As the radome revolves, the emitted radar beam sweeps a circular band or ring around the airborne antenna platform. The height of the band is determined by the radar beam elevation angle, typically between approximately 15 and 20 degrees. Hence, at a range of about 300 nm, the radar beam will illuminate only those targets positioned within a band of approximately 75 to 100 nm high about the 360 degrees of a circle.

The radome antenna leaves blind spots above and below the aircraft that are not illuminated by the emitted radar beam, numerous airborne or surface threats possibly being located in these unilluminated areas. Further, the conventional radome antenna emits a single beam of electromagnetic energy having a finite width and height, the beam completing a single revolution on the order of once every 10 seconds. Therefore, the band swept by the beam is not continuously illuminated, but rather, is only illuminated intermittently. Another problem associated with known radome antennas is the creation of blind spots due to airframe interfernce.

The E-1 and E-2, being carrier-based aircraft, have antenna of relatively small size; however, have succeeded in achieving remarkable performance. The E-3, essentially a B-707 airframe, has a heavy dish antenna on the order of 11,000 pounds of relatively large size, on the order of 30 feet in diameter. Even with such a large antenna, the accuracy of known airborne radars tend to be worse than their ground-based counterparts by factors of ten.

Other approaches for mounting EW type antennas include conformal radar which utilizes wing structure as the vehicle for mounting of the antenna. However, many problems exist with this type of installation due to interference with the structure itself, engines/propellers, and other components of the aircraft.

DISCLOSURE OF THE INVENTION

It is, therefore, an object of the present invention to provide an antenna for an airborne antenna platform which increases antenna effectiveness by increasing the size of the antenna without an attendant increase in antenna weight.

Another object of the present invention is to provide an airborne antenna platform capable of illuminating a spherical space, surrounding the platform, with electromagnetic energy in a near continuous manner.

Yet another object of the present invention is to provide an antenna for an airborne antenna platform configured so as to minimize blind spots due to airborne interference.

The principal feature of the present invention is the provision of a totally new approach for the transmission and receipt of electromagnetic radiation from an antenna of an airborne antenna platform, such function now being accomplished by means of large dish antenna and the like. In accordance with the present invention, there is provided an airborne antenna platform comprising an aircraft to which is fitted, in a unique fashion, an antenna comprising a circular ring or hoop antenna integrated into the existing airframe, for example, a C-130 airlifter. The ring antenna is approximately 92 feet in diameter and is attached to the existing wing external store fitting on the outer wing panels of the C-130 as well as to the aft fuselage and the nose. The antenna is, typically, housed in an elliptical shell, or housing a circular aperture antenna which has a constant pattern unaffected by the wings, tail, and fuselage, being positioned inside the shell.

Another important feature of the present invention is the provision of a large circular ring or loop antenna which comprises an array of dipole elements positioned so that, with electronic time phasing of the dipole array, it is possible to shift the antenna beam in both azimuth and elevation to provide spherical coverage about the airborne antenna platform.

In addition to the highly desirable feature of spherical coverage, the dipole antenna arrangement of the present invention permits simultaneous ranging in several directions due to the phase shifting aspects of the antenna. The multi-directional beam feature provides the advantage that the airborne radar platform is not blind to all directions, save one, as in a single-beam, rotating dish antenna.

Significant advantages of the present invention include excellent range against low RCS targets, reduced jammability, improved resolution, and adaptive beams for ECM.

Other significant advantages of the present invention include the use of the airborne antenna platform as a radar system, Jamming system or relay station for enhancing communication.

BEST MODE FOR CARRYING OUT THE INVENTION

Figure 1A:
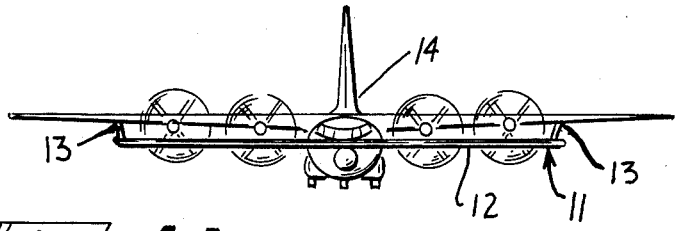
FIGS. 1A–1C illustrate the airborne antenna platform of the present invention.
Figure 1B:
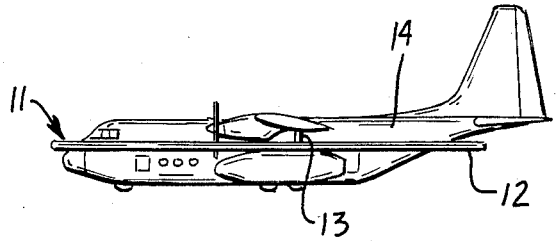
Figure 1C:
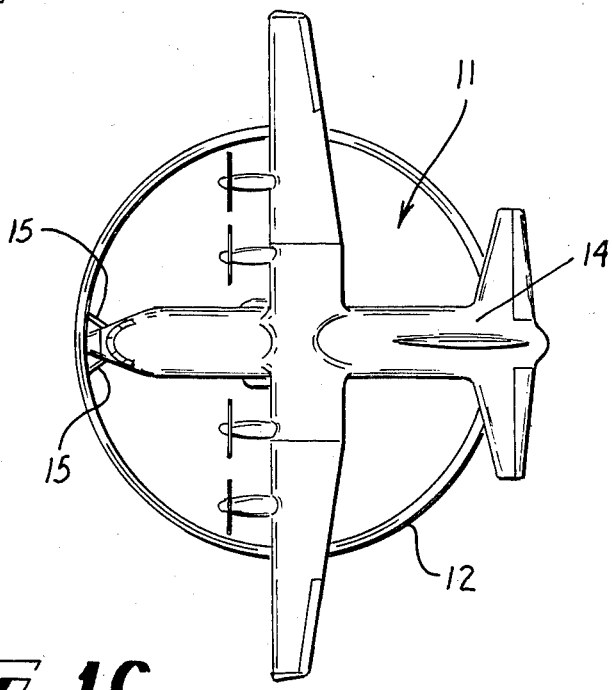
Figure 2A:
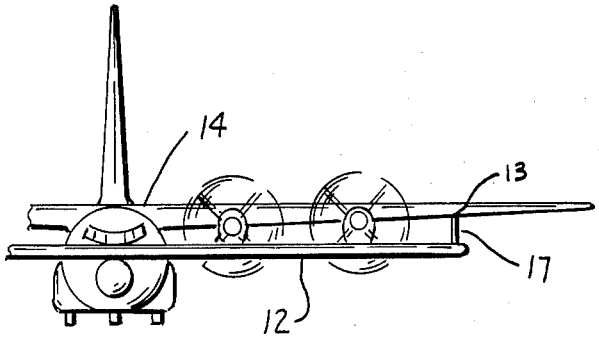
FIGS. 2A–2C illustrate the mounting arrangement for affixing the airborne antenna of the present invention to an aircraft.
Figure 2B:
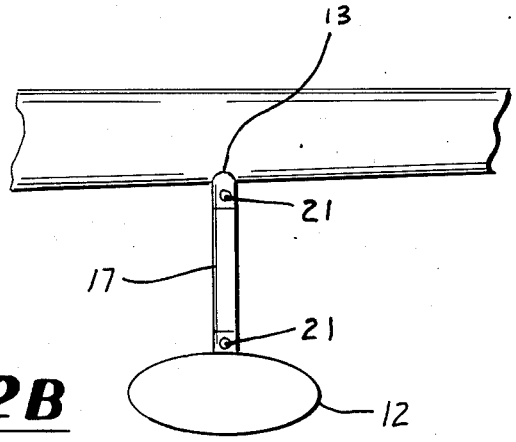
Figure 2C:
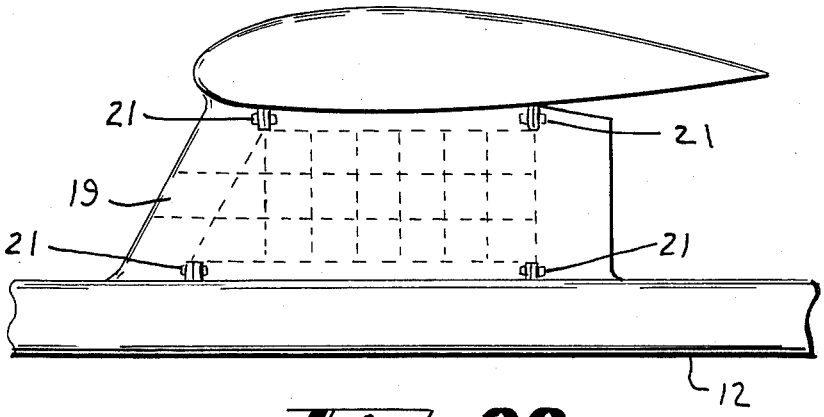

Referring to FIGS. 1A–1C, an airborne antenna platform, generally indicated at 11, is illustrated and comprises a ring or hoop antenna 12 affixed to an aircraft 14, such as, for example, a Lockheed C-130 airlifter. The antenna 12 is attached to existing wing structural elements or hard points 13 on the outer wing panel, as best illustrated by FIGS. 1A and FIGS. 2A–2C, by means of a pair of fasteners 17 thus providing for easy retrofit to an existing, undedicated aircraft configuration. The antenna 12 is also affixed to the afterbody of the fuselage just under the horizontal tail as well as to the nose of the aircraft utilizing strut extensions 15 as best seen in FIG. 1C.

Due consideration must be given to the distance of the ring antenna 12 beneath the wing and the geometry of the aircraft's attitude during takeoff and landing rotation. This consideration is of particular importance in terms of the location of the tail during rotation in order to minimize the possibility that the antenna 12 will strike or contact the ground during takeoff or landing.

Attachment members 15, 17 are shown in FIGS. 1A–1C and FIGS. 2A–2C for affixing the ring antenna 12 to the wing of the aircraft 14. Because the wings of the aircraft 14 experience flexure during flight, oftentimes up to thirteen inches from their static position, it is necessary to attach the ring antenna 12 in a fashion to permit such flexure without damage to the antenna 12. Therefore, the attachment member 17 includes a load bearing support 19 which is pivotally attached to the wing and antenna 12 at pivot points 21. It should be noted that each attachment point of the ring antenna 12 to the aircraft 14 will permit pivotal movement, the fasteners 17 shown in FIGS. 2A–2C being provided as one example of such a pivotal attachment arrangement.

Figure 3:
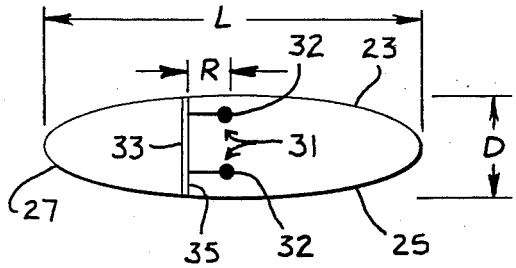
FIG. 3 is a cross-sectional side view of the airborne antenna platform of the present invention.
Figure 4:
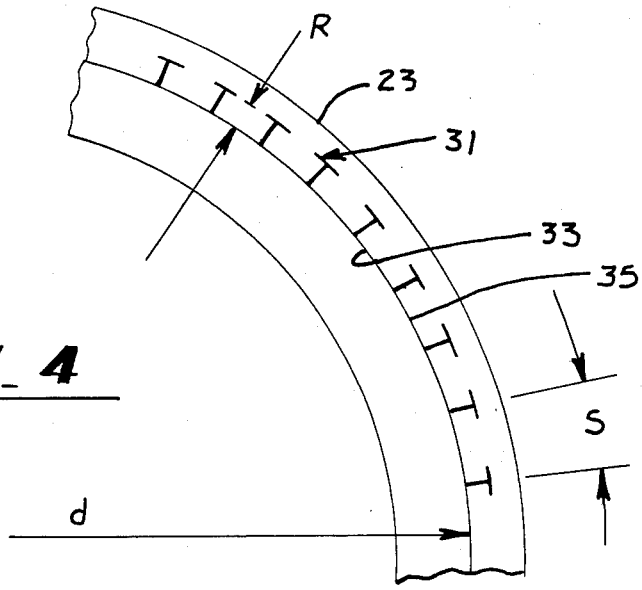
FIG. 4 is a cross-sectional top view of the airborne antenna platform of the present invention.

As shown in FIG. 3, the antenna 12 includes an elliptical envelope or housing 23 having a length L and a depth D, the ratio of L to D being on the order of about 2.6:1. The greater the depth of D, the greater the gain to the antenna 12. Current design of the subject antenna reveals a length L on the order of about 48 inches to about 80 inches and a depth D on the order of about 18 inches to about 30 inches. The elliptical envelope 23 provides extremely favorable aerodynamic characteristics including reduced drag and positive lift.

The outward facing portion 25 of the envelope 23 is, preferably, constructed from a material which is essentially transparent to the transmission of electromagnetic energy, such as, for example, KEVLAR; however, any other suitable material can be employed. The inward facing portion 27 of the envelope 23 is constructed from a material chosen for its high strength and light weight, such as, for example, a carbon filament composite material.

Within the envelope 23 is an array of dipole stations, generally indicated at 31, comprising a plurality of dipoles 32 such as, for example printed circuit dipoles or the like. Each dipole 32 is affixed to a dipole ground plane 33 having a metallic reflection surface 35 for reflecting electromagnetic radiation and for preventing the transmission of electromagnetic radiation inward of the antenna 12.

Each dipole 32 is spaced a distance R from the ground plane 33, R being on the order of approximately $\frac{3}{8}$ of a wavelength of the transmitted electroma-gnetic energy. The spacing R provides for an individual element beam pattern which can properly illuminate the array circular aperture as will be more fully described hereinafter. Spacing S, between elements 31, is preferably on the order of approximately $\frac{1}{2}$ of a wavelenght of the transmitted electromagnetic energy.

When the ring antenna 12 is specifically attached to the hard points 13 of a Lockhead C-130 airlifter, the diameter d of the ring of the antenna 12 will be on the order of about 92 feet. A 92-foot diameter ring allows for an antenna having a horizontal aperture of 42 wavelengths in the UHF band (400–460 MHz) or 82 wavelengths in the L-band (800–900 MHz).

Printed circuit dipole antennas have previously been constructed and tested at 2KW peak power at 30,000 ft. which have a 2 to 1 or lower voltage standing wave ratio (VSWR) across the 400 to 460 or 800 to 900 MHz bands. Spacing the dipoles 32 approximately $\frac{3}{8}$ wavelength from the ground plane 33 will result in an individual element pattern which will properly illuminate the array circular aperture. Since digital stepping of the antenna beam in azimuth is planned, the problems of mutual coupling are not viewed to be a problem because the antenna is intended to be a phased array antenna arrangement as will be explained in more detail hereinafter.

With a diameter d on the order of about 92 feet, a total of 225 dipole stations 31 are necessary for the antenna to operate in the UHF frequency. An L-band configuration would utilize 450 dipole stations 31. Azimuth beam widths of 2.4 degrees and 1.2 degrees (assuming 32dB sidelobes with a cosine-cubed distribution) and elevation beam widths of 40 degrees and 20 degrees, for UHF and L-bands, respectively, are anticipated. Gains at 25 dB at UHF and 31 dB at L-band are also expected.

The antenna 12 of the present invention is intended to be electronically steerable phased array antenna. Having beam steering, which is essentially inertialless, is a cost effective approach when compared to a dish antenna, particularly when the mission requires surveying large solid angles while tracking large numbers of targets and perhaps guiding interceptors as well. Whereas one or more dish radars might handle tens of targets simultaneously, if hundreds or even thousands, of targets are involved, electronic steering is the only practical answer.

Referring to FIGS. 5A–5F, a preferred configuration of dipoles 32, for each dipole station 31, is illustrated for providing beam tilt to insure spherical illumination of the volume surrounding the airborne platform. Each station 31 includes four vertically aligned dipoles 37 and two sets of horizontally aligned dipole pairs 39, one pair positioned above dipoles 37 and the other being positioned beneath. Using the arrangement of FIGS. 5A–5F, it is possible to shift the beam path, as indicated by arrow W, with electronic phase shifting of dipoles 32 from top to bottom and back again so that the beam will tilt.

Figure 6:
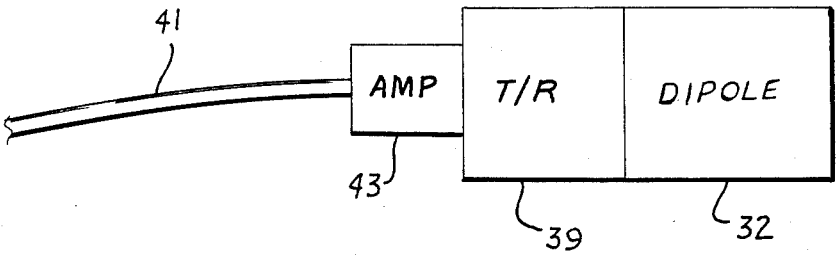
FIG. 6 is a block diagram illustrating the connection arrangement of each dipole.
Figures 5A, 5B, 5C, 5D, 5E, 5F:
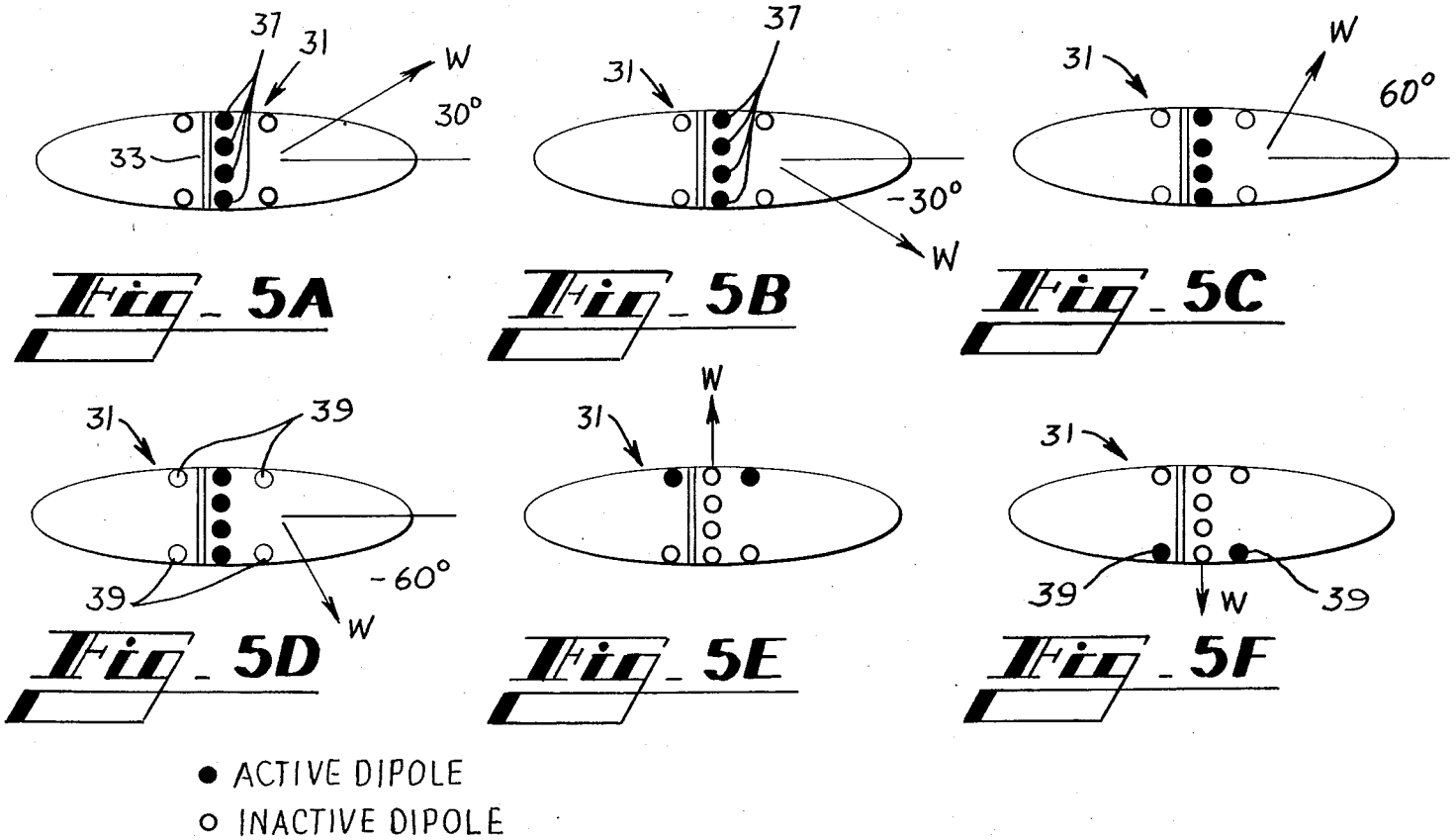
FIGS. 5A–5F are cross-sectional side views of the dipole arrangement illustrating the directional nature of the transmission characteristics of a dipole station.

As seen in FIG. 6, each dipole 32 utilizes a transmitter/receiver module 39, each module 39 being fed by a fiber optic cable 41 to an optical/electrical converter amplifier 43. This approach provides a high average power which maximizes echo strength to received noise.

The system provides programmable beam steering for changing dwell times and elevation beam shapes. Thus, adaptive null steering is available for anti-jamming.

Figure 7:
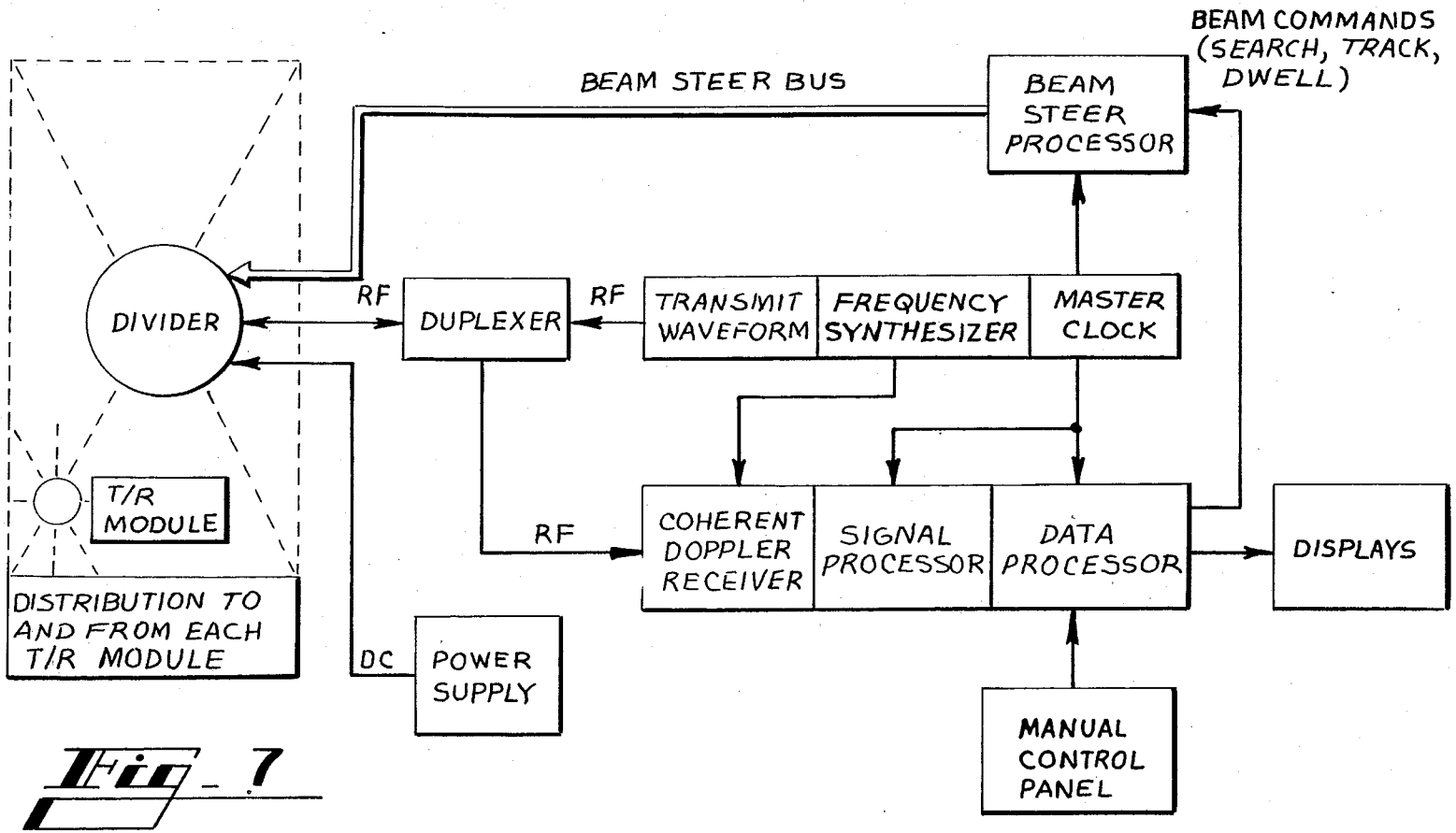
FIG. 7 is a block diagram illustrating the circuitry for steering the antenna of the airborne antenna platform of the present invention.

Referring to FIG. 7, a block diagram of the circuitry for steering and processing the electromagnetic energy transmitted and received by the antenna of the present invention, is provided. The radar system itself is a pulse-doppler radar system. The airborne pulse-doppler radar system of the present invention must be corrected for aircraft instabilities, both frequency (vibrations) and low frequency (changes in pitch, roll, and yaw). These corrections are easily made by sensing them with an inertial system and correcting the returns accordingly.

I claim:

1. An airborne antenna platform comprising:

(a) an aircraft having wing structural elements for the attachment of external equipment;

(b) an antenna housing having a substantially circular configuration and a substantially elliptical cross-section, said antenna housing cross-section having a major axis L and a minor axis D, the ratio of L to D being on the order of about 2.6 to 1;

(c) a plurality of attachment members for flexibly affixing said antenna housing to said aircraft, said attachment members comprising:

(1) a pair of fasteners having a predetermined length such that the distance of the antenna housing beneath the wing of said aircraft minimizes the possibility that said housing will contact the ground during takeoff or landing, each of said fasteners being adapted for pivotal attachment to said wing structural elements and to said housing, said fasteners having at least a load bearing support;

(2) strut extensions for attaching said antenna housing to the nose of said aircraft; and (3) fastener means for fastening said antenna housing to the afterbody of the fuselage of said aircraft; and (d) an antenna, housed within said antenna housing, for transmitting and receiving electromagnetic energy.

2. An airborne antenna platform according to claim 1, wherein the outward facing portion of said antenna housing is constructed from a material which is essentially transparent to electromagnetic energy.

3. An airborne antenna platform according to claim 2, wherein the inward facing portion of said antenna housing is constructed from a material having a high strength to weight ratio.

4. An airborne antenna platform according to claim 3, wherein said antenna comprises (a) an array of dipole stations, each station comprising at least one dipole for transmitting and receiving electromagnetic energy; and (b) a dipole ground plane extending the circumferential length of the interior of said antenna housing, and having an outward facing electromagnetic energy reflector, each of said dipoles being affixed to said dipole ground plane.

5. An airborne antenna platform according to claim 4, wherein:

(a) each of said dipoles is spaced approximately $\frac{3}{8}$ of a wavelength of the wavelength of the electromagnetic energy transmitted by said antenna; and (b) each dipole station is spaced approximately $\frac{1}{2}$ of a wavelength of the wavelength of the electromagnetic energy transmitted by said antenna.

6. An airborne antenna platform according to claim 5, wherein each dipole station comprises:

(a) a plurality of vertically aligned dipoles; and (b) two sets of horizontally aligned dipole pairs, one pair being positioned above said vertically aligned dipoles and one set positioned beneath.

7. An airborne antenna platform according to claim 6, wherein each dipole has a transmitter/receiver module for transmitting and receiving electromagnetic energy.

8. An airborne antenna platform according to claim 7, wherein said antenna is an electromagnetically steerable phased array antenna.

* * * * *